US007632132B2

(12) United States Patent
Nishio et al.

(10) Patent No.: US 7,632,132 B2
(45) Date of Patent: Dec. 15, 2009

(54) CAMERA MODULE CONNECTOR

(75) Inventors: Atsushi Nishio, Tokyo (JP); Takashi Kawasaki, Tokyo (JP); Makoto Murayama, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 12/213,104

(22) Filed: Jun. 13, 2008

(65) Prior Publication Data

US 2008/0311782 A1 Dec. 18, 2008

(30) Foreign Application Priority Data

Jun. 15, 2007 (JP) ..... 2007-159449

(51) Int. Cl.
*H01R 13/627* (2006.01)

(52) U.S. Cl. ..... 439/357

(58) Field of Classification Search ..... 439/357, 439/352, 353, 354, 361, 68, 70
See application file for complete search history.

(56) References Cited

U.S. PATENT DOCUMENTS 6,905,344 B2 * 6/2005 Nishio et al. ..... 439/68
7,077,664 B1 * 7/2006 Wang et al. ..... 439/70
7,387,536 B2 * 6/2008 Wang ..... 439/610
2003/0218873 A1 11/2003 Eromaki et al.
2005/0215087 A1 9/2005 Asai et al.
2006/0105631 A1 5/2006 Yang

FOREIGN PATENT DOCUMENTS

JP 2006-67443 A 3/2006
WO WO 2007/041484 A1 4/2007

* cited by examiner

*Primary Examiner*—Chandrika Prasad
(74) *Attorney, Agent, or Firm*—The Nath Law Group; Jerald L. Meyer; Stanley N. Protigal

(57) ABSTRACT

A module connector reliably locks a module such as a camera module, which is accommodated, to prevent the module from falling and make a module connector in lower profile. This module connector has contact pins (120) that electrically connect with the module inside a container (110) in which the camera module is inserted. Retaining members (150) are provided in sides of the container (110), elastically deform when the module is inserted such that claw parts (159), which form the tip parts of arm parts (158) projecting toward the container (110), move to the sides of the container (110), and engage with an engaged part (230) of the camera module accommodated in the container (110). An arm part (158) connects with an upper end part of a second body part (156) bent from the tip of a first body part (154), which projects toward the container (110) in the side of the container (110), in the direction going away from the container (110) and extends upward.

3 Claims, 7 Drawing Sheets

CAMERA MODULE CONNECTOR

CROSS REFERENCE TO RELATED APPLICATIONS

The disclosure of Japanese Patent Application No. 2007-159449, filed on Jun. 15, 2007, including the specification, drawings and abstract, is incorporated herein by reference in its entirety.

BACKGROUND OF THE INVENTION

1. Field of the Invention

The present invention relates to a module connector to which a module such as a camera module with a solid state image sensor is connected.

2. Description of the Related Art

Conventionally, as disclosed in, for example, Japanese Patent Application Laid-Open No. 2006-67443, a connector that connects with a module, which is an electronic component such as a camera module, has a spring hook that projects toward the interior of the container, which accommodates the module, to prevent the module in the container from falling.

FIG. 1 and FIG. 2 illustrate a conventional connector. FIG. 1 is a schematic longitudinal cross-sectional view showing a connector, illustrating the configuration of the conventional connector and a module mounted in the connector. FIG. 2 is a schematic cross-sectional view showing a state where the module is attached to the connector shown in FIG. 1.

Connector 10 shown in FIG. 1 and FIG. 2 attaches built-in module 20 to the equipment.

First, module 20 attached to this connector 10 will be described. Module 20 is a camera module mounted in, for example, mobile telephones, and has lens part 24 above module body 23 which is approximately a quadrilateral and has substrate 21 in the bottom face. Further, near corner parts in module body 23, engaging parts 22 are formed by making a notch that continues from the middle to the upper face of module body 23. Further, substrate 21 has a plurality of contact pads (not shown) connected with the contact segments of connector 10.

Connector 10 has housing 12 that opens upward and that has container 11 which builds in module 20, contact segments (not shown) that electrically connect with contact pads of substrate 21 inside container 11 and spring hooks 13 that engage with engaging parts 22 of module 20.

Spring hooks 13 are flexible and extend toward container 11 from shield cases 14 covering the outer peripheral surfaces of housing 12, engage with engaging parts 22 of the module to be accommodated in container 11 at the tips of free tip parts 13*a* and thereby prevent the module from falling.

Spring hooks 13 are each placed to incline from the top end part of shield case 14 toward the center of bottom face 10*a* of container 11 through inside housing 12, and free tip parts 13*a* are each positioned inside the container.

By building module 20 in container 11 by pressing down module 20 from above connector 10 into container 11, spring hooks 13 are elastically deformed by the downward press by the bottom face of module 20 and escape outward.

Then, when module 20 is inserted to a predetermined position inside container 11, free tip parts 13*a* of spring hooks 13 are restored to the original state, maintaining the contact pads of the substrate in contact with the contact segments and engage with engaging faces 22*a* of engaging parts 22, that is, the upper face of module 20 (see FIG. 2). By this means, spring hooks 13 prevent module 20 attached to connector 10 from falling.

Further, when the camera module is removed, free tip parts 13*a* of spring hooks 13 slide pressing against the side faces of the camera module moving in the removing direction off the lock positions with engaging parts 22.

To prevent deformation of spring hooks 13 itself due to this slide and secure the restoring force of free tip parts 13*a*, spring hooks 13 are configured to have deforming parts of a predetermined length L from the top end of shield cases 14 to free tip parts 13*a*.

Recently, electronic devices such as mobile telephones in which modules such as camera modules are mounted, are miniaturized, and, accompanying this, making module connectors itself in lower profile used in mounting in the module is desired.

However, according to the configuration of a conventional module connector, to prevent deformation of spring hooks 13 when the module is removed and secure the restoring force of free tip parts 13*a*, the length L of deforming parts between the top ends of shield cases 14 and free tip part 13*a* need to be secured.

For this reason, the side wall parts surrounding container 11 require a height L2 so that the length L of the deforming parts extending from the top end of the side wall parts toward bottom face 10*a* of container 11 is secured, and it was difficult to make module connectors in lower profile.

SUMMARY OF THE INVENTION

It is therefore an object of the present invention to provide a module connector that is able to reliably lock modules such as camera modules, which are accommodated, to prevent the modules from falling and make module connectors in lower profile.

The present invention has a connector body with a container in which a module is inserted and which opens upward; a connecting part which is provided inside the container and which electrically connects with the module accommodated in the container; and a flexible retaining member which is provided in a side of the container in the connector body, which deforms elastically when the module is inserted such that a tip part of an arm part projecting toward the container moves to the side of the container and which restores to an original state when the module is accommodated in the container so that the tip part engages with a front face of the module, whereby: the arm part is provided to bend toward the container from an upper end part of a body part provided in the side of the container along the direction of insertion; and the body part comprises a first body part that projects toward the container in the side of the container and a second body part that bends from a tip of the first body part in a direction going away from the container and extends upward, and achieves the above object.

DETAILED DESCRIPTION OF THE PREFERRED EMBODIMENT

An embodiment of the present invention will be described below in detail with reference to the accompanying drawings.

Figure 1:
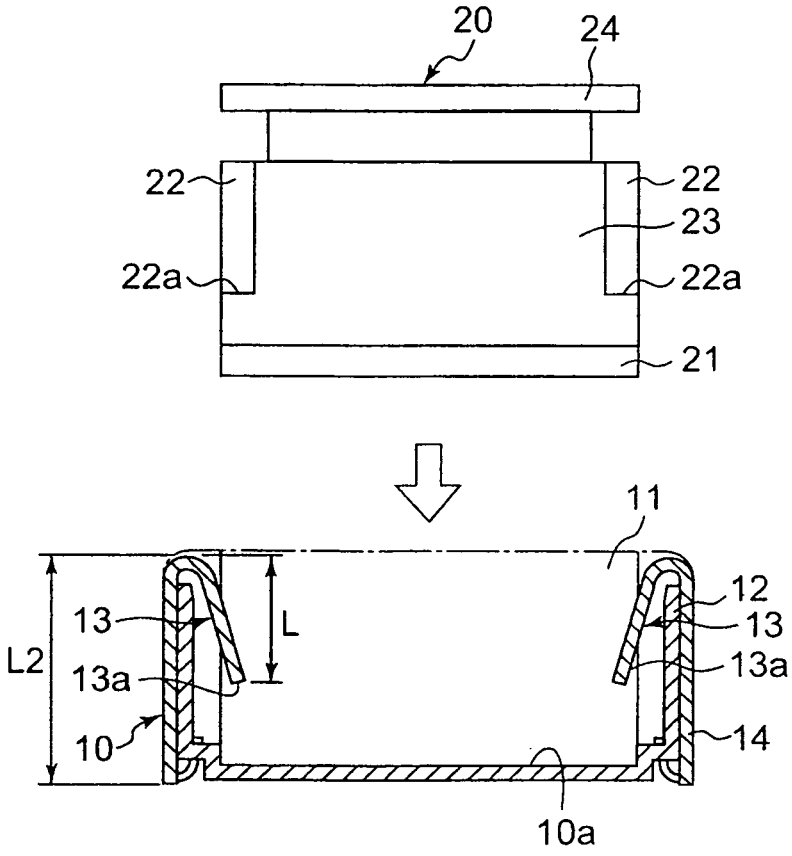
FIG. 1 illustrates a conventional connector.
Figure 2:
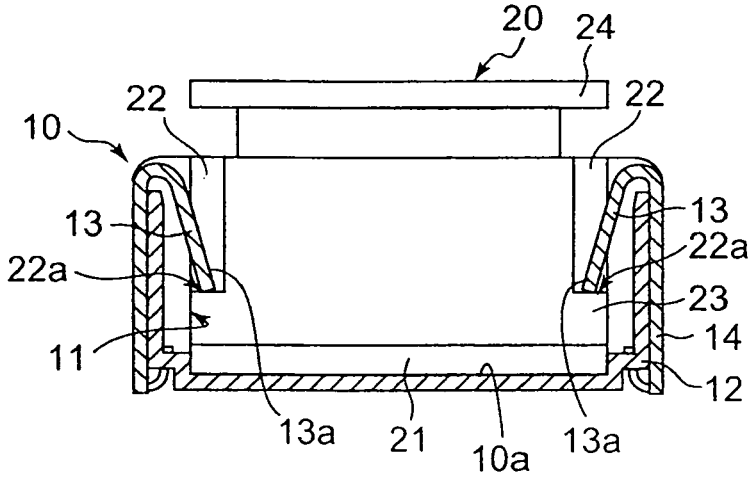
FIG. 2 illustrates a conventional connector.
Figure 3:
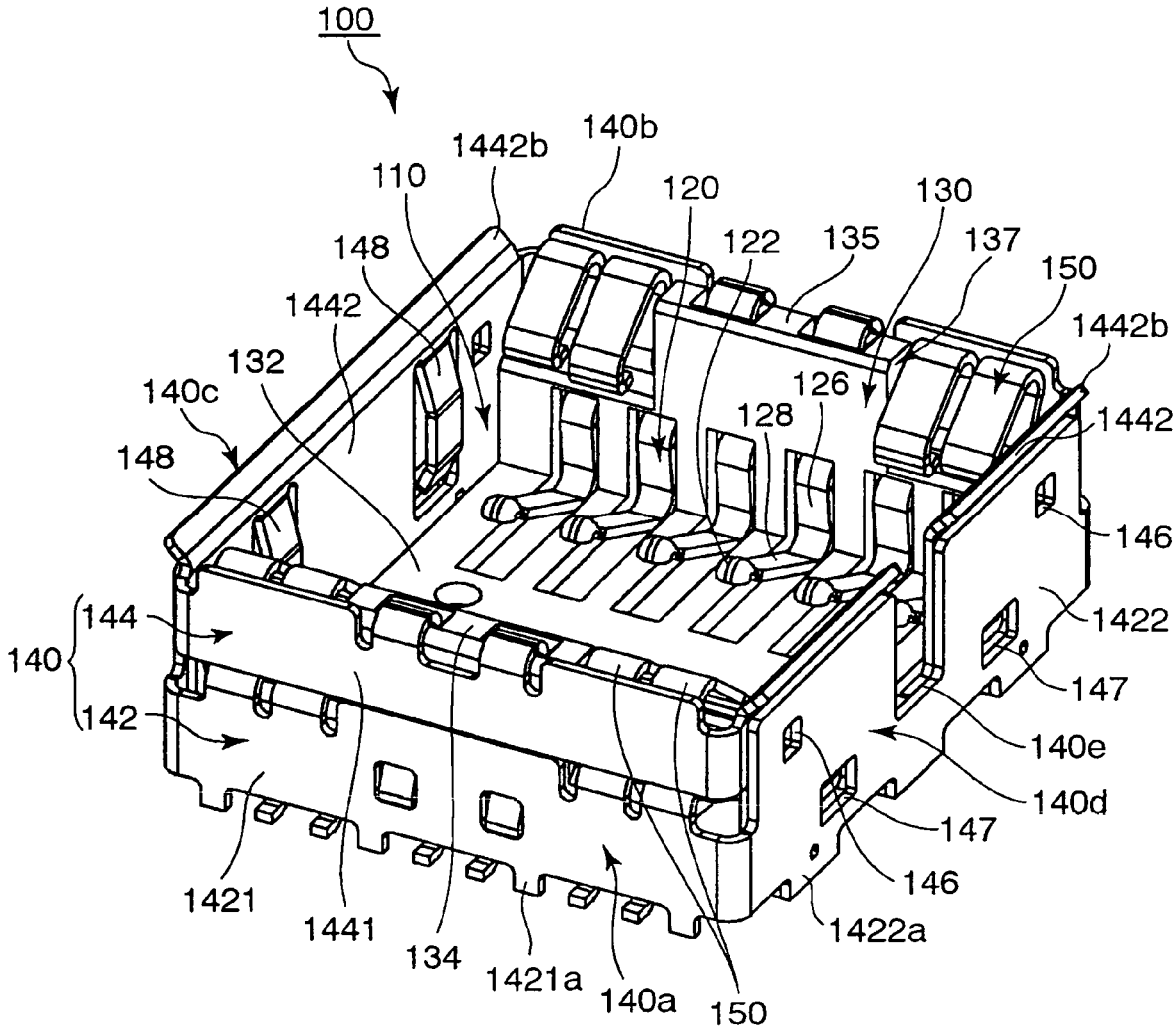
FIG. 3 is a perspective view illustrating a configuration of a module connector according to an embodiment of the present invention.

FIG. 3 is a perspective view illustrating a configuration of a connector according to an embodiment of the present invention. Connector 100 shown in FIG. 3 according to the present embodiment is used when a camera module, which is an electronic component, is mounted on a substrate.

Further, this camera module mounted on the substrate through connector 100 has, for example, base part 220 (see FIG. 7) that has virtually a rectangular parallelepiped shape in lower part 210 (see FIG. 7) of a lens unit with a lens that guides light to a solid state imaging sensor such as a CMOS camera module, and that has contacts on a rectangular-shaped bottom face along two separate parallel sides. Connector 100 holds the camera module by accommodating this base part 220.

Connector 100 shown in FIG. 3 has housing 130 that opens upwards, that is formed as a square box with concave container 110 for accommodating a camera module (not shown) and that has contact pins 120, shell part 140 that is rectangular from a plane view and that covers the periphery of housing 130, and retaining members 150 that lock the camera module accommodated in container 110 to prevent the camera module from falling. In connector 100, the connector body is formed with housing 130 and shell part 140.

Figure 4:
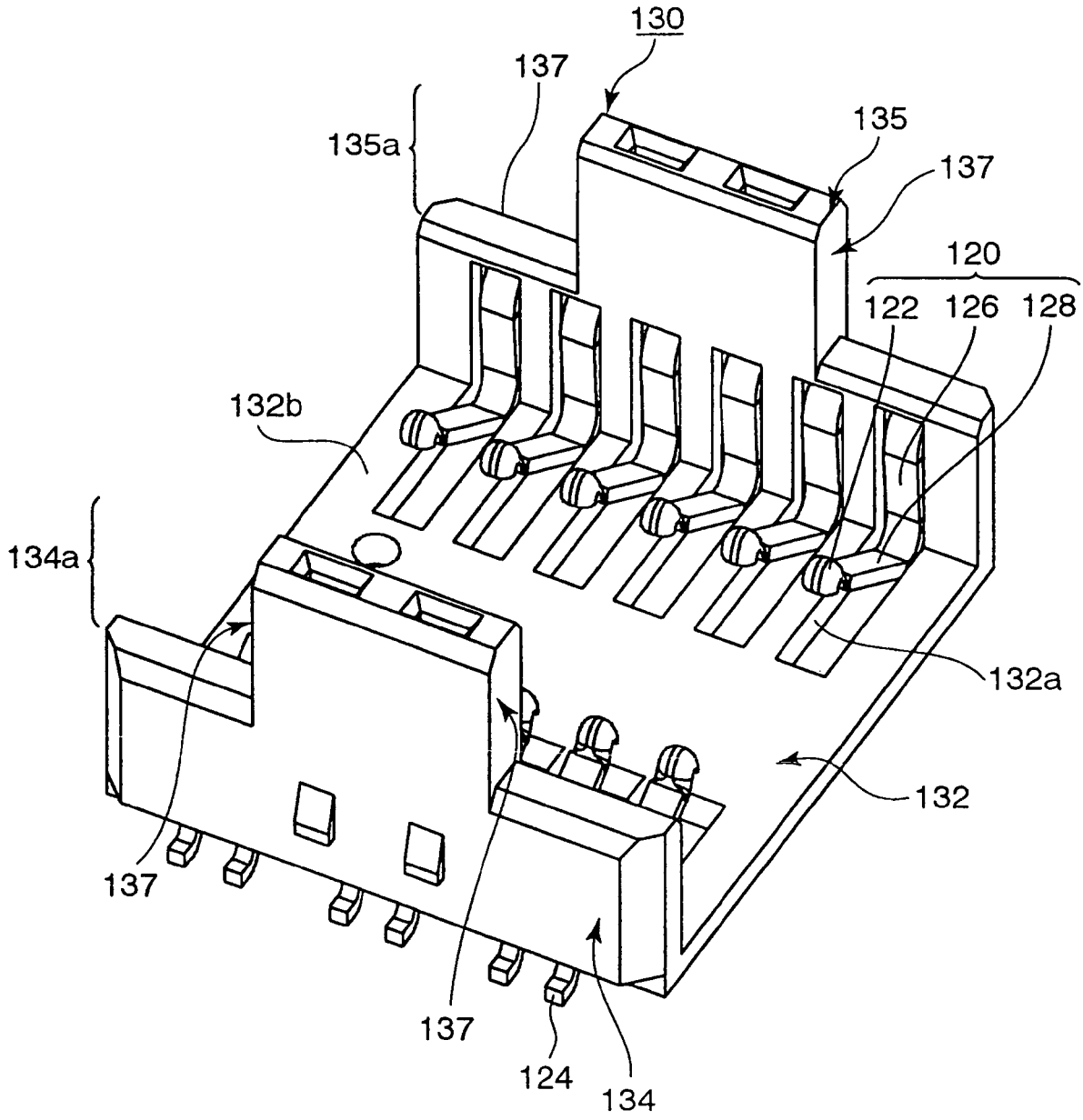
FIG. 4 is a perspective view of a housing that removes a shell part from the connector.
Figure 5:
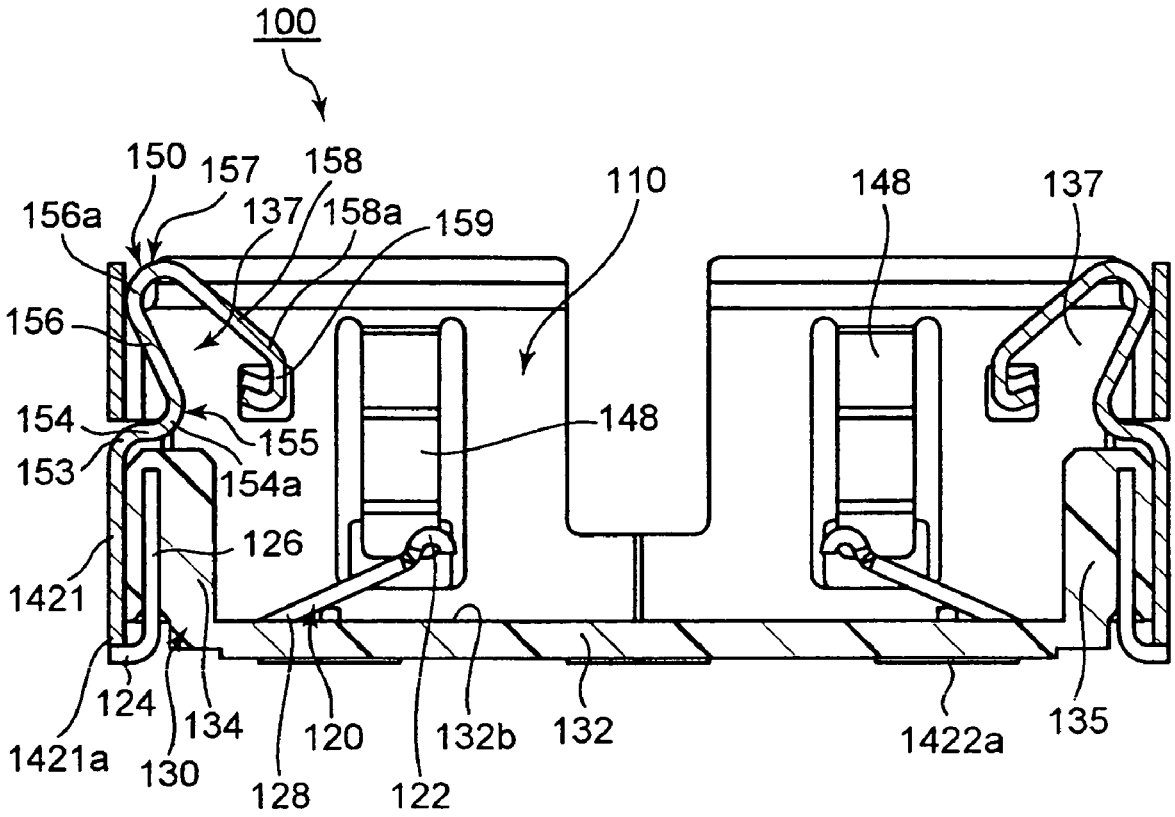
FIG. 5 is a cross sectional view illustrating the configuration of the module connector shown in FIG. 3.

FIG. 4 is a perspective view of the housing removing the shell part in the connector according to an embodiment of the present invention. FIG. 5 is a cross sectional view illustrating the configuration of the connector shown in FIG. 3.

Housing 130 shown in FIG. 3 to FIG. 5 is formed with insulating substances such as plastic, and has flat rectangular bottom plate part 132 and side wall parts 134 and 135 that rise vertically from two separate parallel sides in bottom plate part 132.

Bottom plate part 132 defines the bottom face part of container 110 and matches with the shape of the bottom face (the bottom face of the base part) of the camera module to be accommodated in container 110. Further, side wall parts 134 and 135 are placed facing each other and define a pair of side wall parts of container 110 with facing inner peripheral surfaces.

As shown in FIG. 3 and FIG. 4, along two sides of bottom plate part 132, a plurality of slits 132*a* are formed extending in directions facing each other, and contact parts 122 which form the tip parts of contact pins 120 are arranged in parallel projecting upward from these slits 132*a* on bottom plate part 132.

Contact pins 120 are connected with the contacts of the camera module to be accommodated in container 110, and are provided in side wall parts 134 and 135 such that these contact pins 120 are pressed into places meeting contacts provided on the bottom face of the camera module (the bottom face of the base part).

These contact 120 are each formed with flexible conducting members and formed by processing (e.g. bending) a long metal plate.

To be more specific, contact pins 120 have lead part 124 that are each formed with a long conductive metal plate and that stick out from the lower end of housing 120 in parallel to the bottom face of connector 100 (the lower face of housing 130), pin fixing part 126 provided in the side wall and pin arm part 128 that forms contact part 122 at the tip.

Lead part 124 is joined with the pattern on the substrate when connector 100 is placed on the substrate and continues with one end of pin fixing part 126 that forms the center of contact pin 120 at the base end.

Pin fixing parts 126 are reverse U-shaped so that pin fixing parts 126 rise upward from the base end of lead parts 124 in wall parts 134 and 135 and fall downward from the upper ends of these rising parts. FIG. 3 and FIG. 4 show only the falling parts which appear in the side of container 110 and, FIG. 5 shows rising parts.

These falling parts are elastically deformable and are placed along the interiors of side wall parts 134 and 135, and pin arm parts 128 located near the corners defined by side wall parts 134 and 135 and bottom plate part 132 continue with the tips.

Pin arm parts 128 are bent from the tips of the falling parts and are inserted in slits 132*a* of bottom plate part 132 from the lower ends of side wall parts 134 and 135. By this means, pin arm parts 128 project at an upward angle, toward the interior of the container from the lower ends of side wall parts 134 and 135 and are elastically deformable in the downward direction (the direction of insertion with respect to the container of the camera module).

By this means, contact parts 122, which form the tips of pin arm parts 128, are placed in container 110 and are positioned movably in the direction of insertion of the camera module.

Contact parts 122 are urged in the direction opposite to the direction of insertion (for example, the removing direction). The direction of insertion of the camera module and the direction of press of the camera module are the same direction. For this reason, by inserting the camera module in the container, contact parts 122 touch contacts of the camera module such that contact parts 122 and the contact press against each other.

Contact pins 120 are provided in side wall parts 134 and 135 at regular intervals in the horizontal direction which crosses the direction of insertion at right angles. Further, contact parts 122 of contact pins 120 in side wall parts 134 and 135 are positioned facing each other sandwiching bottom plate part 132.

As shown in FIG. 4, at both ends of upper end parts 134*a* and 135*a* of side wall parts 134 and 135 in which these contact pins 120 are provided, notch parts 137 are formed such that notch parts 137 keep lower levels than the center parts of upper end parts 134*a* and 135*a*. Further, FIG. 5 shows the lower parts of both side wall parts 134 and 135, and notch parts 137.

Figure 6:
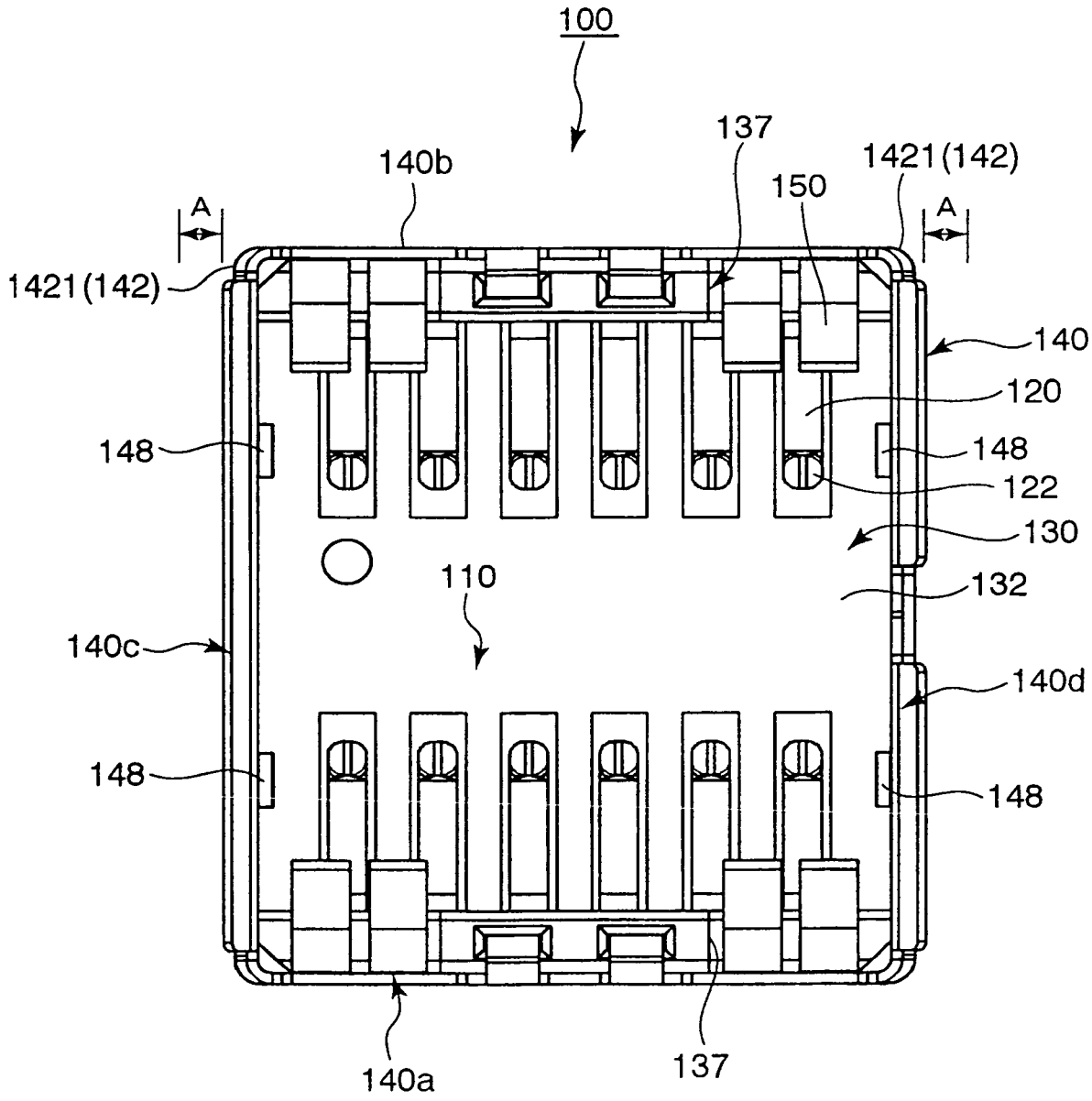
FIG. 6 is a plan view illustrating the configuration of the module connector according to an embodiment of the present invention.

FIG. 6 is a plan view illustrating the configuration of the connector according to an embodiment of the present invention.

As shown in FIG. 3, FIG. 5 and FIG. 6, shell part 140 surrounding the periphery of housing 130, covers the back faces and both end parts of a pair of facing side wall parts 134 and 135.

As shown in FIG. 3 and FIG. 6, shell part 140 has a pair of back plate parts 140*a* and 140*b* that are parallel to each other and that are positioned on the back faces of side wall parts 134 and 135 rising upward from two sides of base plate part 132, and a pair of side plate parts 140*c* and 140*d* that connect with both ends of a pair of back plate parts 140*a* and 140*b* at right angles and that cover a pair of side wall parts 134 and 135 from the side.

Container 110 of connector 100 is defined by a pair of side wall parts 134 and 135 and a pair of side plate parts 140*c* and 140*d*.

Further, as shown in FIG. 3 and FIG. 6, in the interiors of side plate parts 140*c* and 140*d* which face each other sandwiching bottom plate part 132 and, pressing plates 148 are formed that project toward container 110 from the upper end and that are elastically deformable toward the interior. When a camera module is inserted in container 110, pressing plates 148 press against the sides of the camera module inserted in container 110 and hold the camera module.

Further, in a pair of side wall parts formed by side wall parts 134 and 135 and back plate parts 140*a* and 140*b* that cover side wall parts 134 and 135 sandwiching bottom plate part 132, retaining members 150 attached to back plate parts 140*a* and 140*b* are positioned in a state where retaining members 150 project tip parts toward container 110 inserting in notch parts 137 of side wall parts 134 and 135.

Here, the configuration of shell part 140 with back plate parts 140*a* and 140*b* in which retaining members 150 are provided, will be described in detail.

As shown in FIG. 3, shell part 140 has frame body part 142 that is rectangular cylindrical-shaped and that is fit onto the lower part of housing 130 and, above frame body part 142, auxiliary frame part 144 that is rectangular cylindrical-shaped and that is made to match and fit the outer shape of frame body part 142.

Frame body part 142 has lower frames 1421 that are positioned along the lower back of a pair of side wall parts 134 and 135 and form the lower parts of back plate parts 140*a* and 140*b*, and outer plate frames 1422 that cross both ends of lower frames 1421 at right angles and that configure outer face parts of side plate parts 140*c* and 140*d*.

In the lower side parts of frame body part 142 (to be more specific, the lower side part of lower frame 1421 and the lower side part of outer plate frame 1422), ground terminal parts 1421*a* and 1422*a*, which are connected with the ground part of the substrate when the lower parts are mounted on the substrate, are formed (see FIG. 3 and FIG. 5).

The height of outer plate frame 1422 of frame body part 142 (the length in the direction of insertion with respect to the container of the camera module) is nearly equal to the height of side wall parts 134 and 135.

Further, inner plate frame 1442 of auxiliary frame 144 is provided between outer plate frame 1422 and the side part of bottom plate part 132 along the direction of extension of outer plate frame 1422.

This inner plate frame 1442 configures the interior parts of side parts 140*c* and 140*d* and forms side plate parts 140*c* and 140*d* of shell part 140 with outer plate frame 1422. Further, in the upper end side of inner plate frame 1442, frange part 1442*b* is formed inclining outward along the upper end side, and this frange part 1442*b* guides the module smoothly into container 110.

At both ends of the upper side part of lower frame 1421, retaining members 150 are provided with tip parts (claw parts 150 shown in FIG. 5 and FIG. 7) that extend upward and bend back near the upper end parts of side wall parts 134 and 135, so that the tip parts project toward container 110.

Further, upper frames 1441 of auxiliary frames 144 are provided above lower frames 1421 of frame body parts 142 in the back of retaining members 150, and upper frames 1441 configure the upper parts of back plate parts 140*a* and 140*b*.

Here, each retaining member 150 is formed integrally by the same metal plate as lower frames 1421 and is flexible.

The part of this retaining member 150 projecting toward container 110 is positioned to incline at a downward angle from the upper parts of side wall parts 134 and 135 of housing 130 toward container 110, and is elastically deformed in the direction where a module approaches. This allows the lower side parts (claw parts 150 shown in FIG. 5 and FIG. 7) to move toward side wall parts 134 and 135.

Retaining member 150 is formed by carrying out the bending process on the long, flat flexible member that configures shield part 140. Here, retaining member 150 is formed by carrying out the bending process on a long flat metal plate, which is elastically deformable, at separate predetermined positions in the longitudinal direction.

Retaining member 150 shown in FIG. 3, FIG. 5 and FIG. 6 is formed by bending part of the thin metal plate that forms shield part 140, that is, the part of the metal part that continues with lower frame 1421. That is, retaining member 150 is formed integrally with shield part 140, which is rectangular cylindrical-shaped, so that it is possible to reduce labor upon assembling compared to the connector configured apart from shield part 140.

To be more specific, as shown in FIG. 5, retaining member 150 has first body part 154 that bends along the bottom face of notch part 137, from the tip of lower frame 1421 rising from the base end part along the outer face of housing 130, and that projects toward the interior of container 110, second body part 156 that bends from the tip of first body part 154 toward the outside of container 110 and that inclines at an upward angle, arm part 158 that bends from the tip of second body part 156 toward the interior of container 110 and that extends inclining at a downward angle and claw part 159 formed at the tip of the arm part.

First body part 154 is provided to bend from the upper end of lower frame 1421 projecting toward the interior (i.e. toward container part 110) of lower frame 1421.

Tip part 154*a* of first body part 154 is positioned approximately the middle of the thickness of side wall part 134 (side wall part 135) covered by lower frame 1421 in notch part 137, and is configured such that second body part 156 extends upward from this tip part 154*a*.

Upper end part 156*a* of second body part 156 is placed closer to the interior, that is, closer toward container part 110, than is positioned on virtually the same plane as the plane on which lower frame 1421 is positioned, and is positioned at virtually the same height of the upper end part of side wall part 134 (side wall part 135). Here, upper end part 156*a* of second body part 156 is positioned above lower frame 1421, closer to the interior than upper frame 1441 positioned in virtually the same plane as lower frame 1421, and the back part of upper end part 156*a* opposes the interior of upper frame 1441. Further, part of the back part of second body part 156, that is, the back part of upper end part 156*a*, is positioned to abut on upper frame 1441. That is, upper frame 1441 functions as a limiting wall part that limits the movement of second body part 156 in the direction going away from container 110.

Arm part 158 which continues to upper end part 156*a* of this second body part 156 projects toward container 110, and, at the tip part of arm part 158, claw part 159 that curves the lower face and that engages with engaged part 230 of the camera module (see FIG. 8) is formed.

Further, arm part 158 projects tip part 158*a* to approximately the center part of arm part 158, toward the interior from the inner wall of side wall part 134 (side wall part 135).

In retaining member 150 of the present embodiment, lower frame 1421 and first body part 154, first body part 154 and second body part 156, and second body part 156 and arm part 158 continue with each other through the curved, bending parts. Here, angles between lower frame 1421 and first body part 154, first body part 154 and second body part 156, and second body part 156 and arm part 158 decrease in order from between lower frame 1421 and first body part 154, first body part 154 and second body part 156, and second body part 156 and arm part 158.

With this retaining member 150, bending part 153 between lower frame 1421 and first body part 154, first body part 154, bending part 155 between first body part 154 and second body part 156, bending part 157 between second body part 156 and arm part 158, and arm part 158 intervene between the upper end of lower frame 1421 and claw part 159.

The base end parts of first body part 154, second body part 156 and arm part 158 are positioned movably inside notch part 137.

Even in a configuration where the height of connector 100 is lowered and the level of the height of side wall parts defining container part 110 in which retaining member 150 are provided is limited to make connectors in lower profile, it is possible to secure the length of the elastically deforming part (i.e. the length from the upper end of lower frame 1421 to claw part 159) required to move the tip of claw part 159 projecting toward container 110, to the outside of container 110 without exceeding the level of the height of the side wall parts.

Further, with retaining member 150, the configuration between first bending part 153 and arm part 158 configures the elastically deforming part for moving the tip of claw part 159 out of container 110, so that it is possible to reliably secure elasticity even if retaining member 150 is formed with a thin, flat shape and enable an easy process and lower cost.

Further, in shell part 140, pressing plates 148 formed in side wall parts 140*c* and 140*d* are formed with a flexible member, are formed integrally with inner plate frames 1442 and are positioned to project toward container 110 from the interior of inner plate frame 1442. Here, in the interior of inner plate frame 1442, each pressing plate 148 is formed to extend from the upper end toward the lower end and the center part that projects toward container 110 by elastic deformation, is movable toward the interior of inner plate frame 1442.

Next, the operation of attaching the camera module to connector 100 according to the present embodiment will be described.

Figure 7:
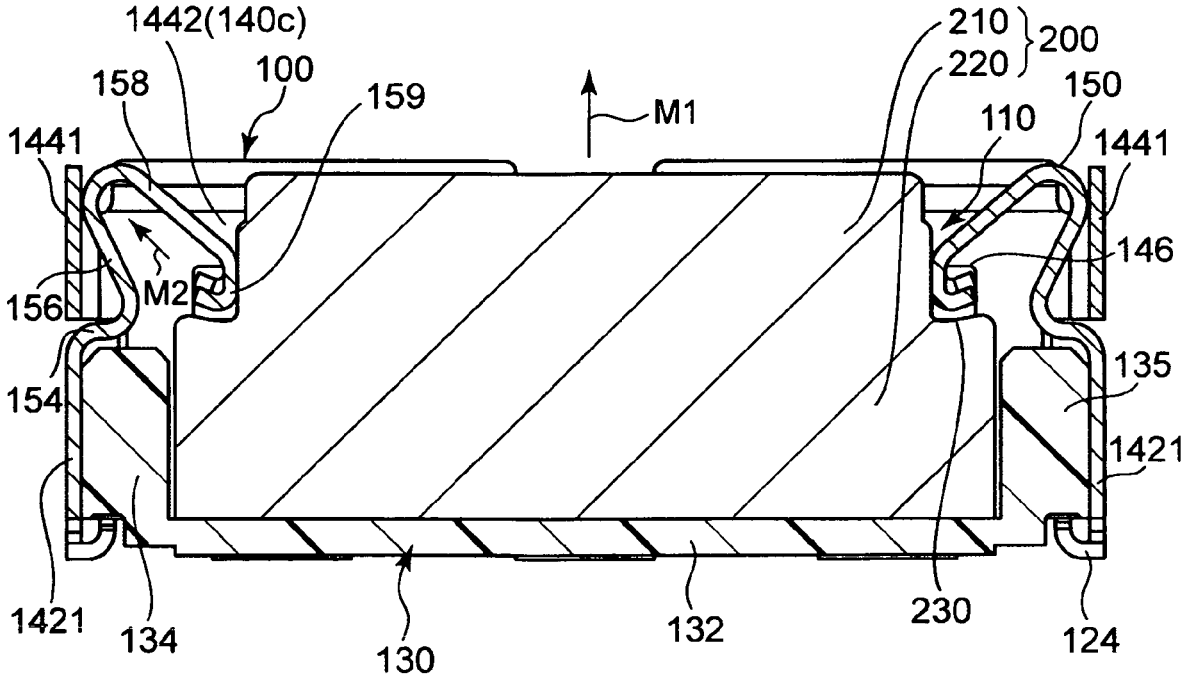
FIG. 7 is a cross sectional view of essential parts showing a state where a camera module is attached to the module connector according to an embodiment of the present invention.

FIG. 7 is a cross sectional view of essential parts showing a state where a camera module is attached to the connector according to the present invention. Further, camera module 200 shown in FIG. 7 differs from the conventional camera module only in the height from the bottom face to the upper face, and the basic configuration of parts to be accommodated in connector 100 are virtually the same. That is, in camera module 200, on the upper part of the outer rim part of base part 220 that extends outward, engaged part 230 that engages with retaining member 150 of connector 100 when camera module 200 is attached to connector 100, is formed.

When a camera module is inserted in container 110 of connector 100, retaining members 150 are pressed against the inner peripheral faces of side wall parts 134 and 135 of housing 130 by the side faces of base part 220 of camera module 200, and are deformed.

Then, contacts (not shown) of the bottom face of base part 220 abut on and press downward contact parts 122. The contacts and contact parts 122 touch one another such that the contacts and contact parts 122 press against each other (not shown). When camera module 200 moves downward, retaining members 150 slide on the side faces of base part 220 of camera module 200 and move to the engaging spaces above engaged parts 230 formed in camera module 200.

When retaining members 150 is positioned in the sides of the engaging spaces, the urge applied to retaining members 150 is released, and retaining members 150 project toward the interior of container 110, engage with engaged parts 230 of the camera module and limits the movement in the removing direction of camera module 200 (the opposite direction to the direction of insertion). By this means, it is possible to prevent camera module 200 falling from the connector.

At this time, camera module 200 is urged in the removing direction by contact parts 122 of contact pins 120 projecting upward from bottom face 132*b* of connector 100, that is, in removing direction M1, and is pressed down from above by claw parts 159 of retaining members 150 engaging with engaged parts 230.

Movement of camera module 200 in removing direction M1 applies weight to arms 158 of retaining members 150 in direction M2 going away from camera module 200. Due to the weight applied to these arms 158 in direction M2, second body part 156 moves toward upper frame 1441 using bending part 155 as a starting point.

Upper end parts 156*a* of second body parts 156 which moved abut on the back faces of upper frames 1441 configuring the upper parts of back plate parts 140*a* and 140*b*. This limits the movement toward the outside of second body parts 156, that is, the movement in the direction of releasing the engaging state of claw parts 159.

Therefore, claw parts 159 of retaining members 150 are limited involuntarily from moving in the direction of releasing the engagement with engaged parts 230 of camera module 200, and the engaged state of claw parts 159 with engaged parts 230 is held.

In this way, according to connector 100 of the present embodiment, retaining members 150 is opposite to the back faces of upper frames 1441 forming the upper parts of back plate parts 140*a* and 140*b* in upper end parts 156*a* of second body parts 156. For this reason, when camera module 200 moves from connector 100 in the removing direction, following the movement of claw parts 159 toward notch parts 137, second body parts 156 move toward upper frames 1441 using bending parts 155 as a starting point.

By this means, upper end part 156*a* of second body part 156 abuts on the back face of upper frame 1441, which limits the movement of upper end part, 156*a*, and limits the movement of claw part 159 continuing to second body part 156 through arm part 158 toward notch part 137.

In this way, connector 100 has: a connector body that has housing 130 with container 110 to which module 200 is inserted and which opens upward, and shell part 140; contact pins (connecting parts) 120 that are provided inside container 110 and that electrically connect with the module to be accommodated in container 110; and flexible retaining members 150 that are provided in sides of container 110 in the connector body, that are deformed elastically when module 200 is inserted such that tip parts 159 of arm parts 158, which projects toward container 119, move toward container 110 and that are restored to the original state when module 200 is accommodated in container 110 so that tip parts 159 engage with the front face (engaging part 230) of module 200.

Arm parts 158 are provided to bend toward container 110 from the top end part of the body part provided along the direction of insertion on the side of container 110. The body part has first body part 154 that projects toward container 110 on the side of the container and second body part 156 that bends from the tip of first body part 154 in the direction going away from container 110 and extends upward.

Therefore, the movement of claw parts 159 of retaining members 150 in the direction of releasing engagement with engaged part 230 of camera module 200 is limited involuntarily by upper frame 1441, so that it is possible to reinforce the engaging state with engaged part 230.

In this way, connector 100 of the present embodiment is able to reliably prevent camera module 200 to be accommodated in container 110 from falling from connector 100 and make connectors in lower profile by lowering the height of the side wall parts surrounding container 110.

Figure 8:
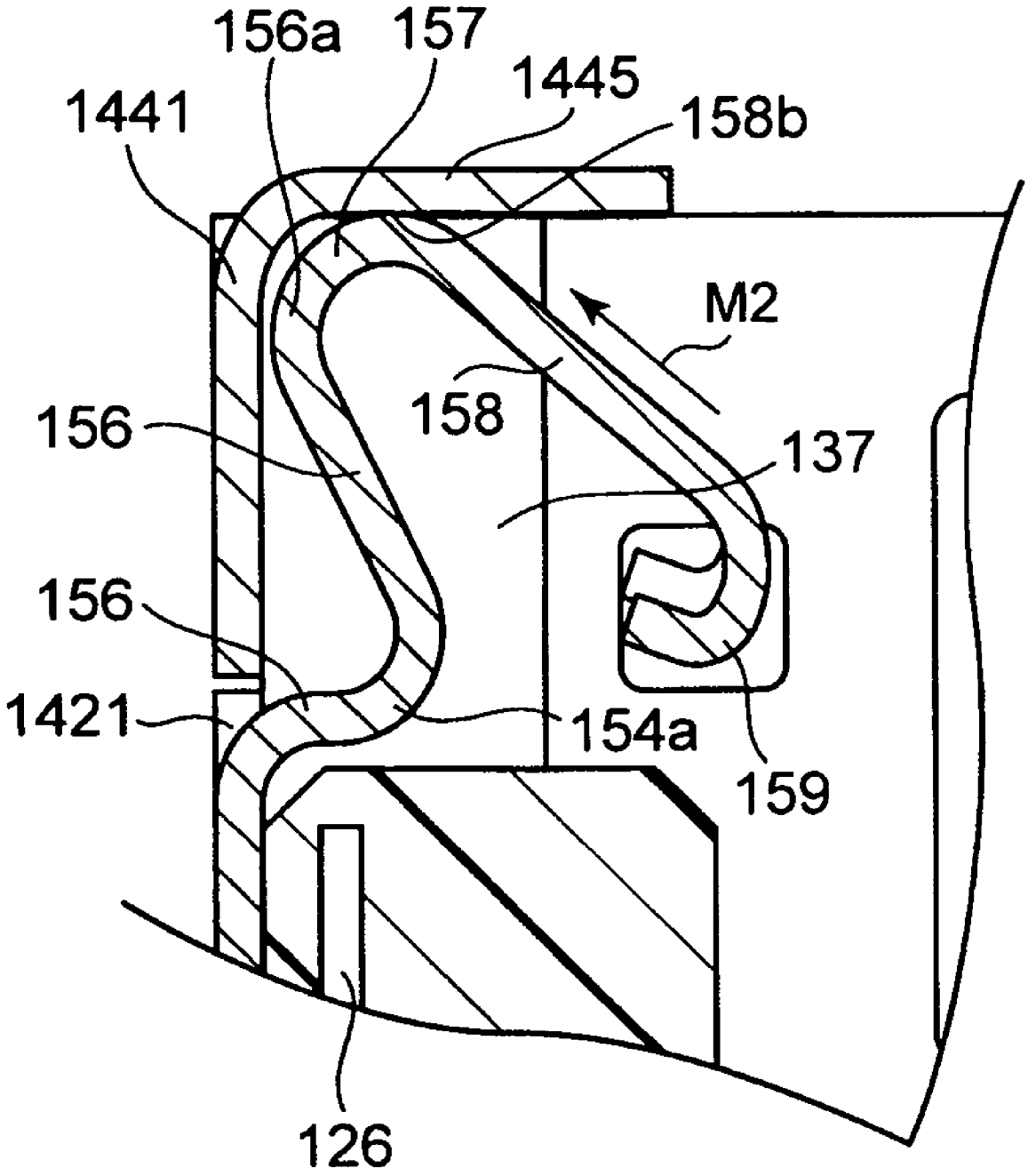
FIG. 8 illustrates an example of a variation of the module connector according to an embodiment of the present invention.

Although upper frame 1441 is configured to abut only on the back face of second body part 156 in retaining member 150, the present invention is not limited to this, and a configuration may be possible where, in connector 100 with the above configuration, upper side part 1445 that projects toward container 110 from the upper end part of upper frame 1441 as shown in FIG. 8 and that covers the upper ends of side wall parts 134 and 135 may be possible.

In this way, the movement of claw part 159 of retaining member 150 toward the outside of container 110 and above container 110 is limited involuntarily by upper frame 1441.

That is, when the movement in the direction of removing module 200 accommodated inside container 110 applies weight to arm part 158 through claw part 159 in direction M2, upper end part 156*a* of second body part 156 abuts on the back face of upper frame 1441 and base end part 158*b* of arm part 158 abuts on upper side part 1445.

In this way, according to the example of the variation of connector 100 shown in FIG. 8, upper frame 1441 and upper end side part 1445 are positioned on the upper face and the outer face of second body part 156 having the inner face facing container 110.

By this means, the movement of retaining members 150 toward the side of container 110 and above container 110 which are the destinations is limited involuntarily by upper frame 1441 and upper side part 1445.

Consequently, the movement of claw part 159, which continues with tip part 158*a* of arm part 158, toward the side of the container and above the container, that is, the movement in the direction of releasing the lock with engaged part 220 (see FIG. 7) of the module, is limited involuntarily, so that it is possible to increase the lock strength of retaining members 150 itself with respect to the module inserted.

Further, with the present embodiment, side plate parts 140*c* and 140*d* of shell part 140 surrounding housing 130 are configured by superimposing auxiliary plate frame 1422 of frame body part 142 and inner plate frame 1442 of auxiliary frame 144.

Further, shell part 140 is positioned to surround a pair of side wall parts 134 and 135 and has a pair of flat side plate part 140*c* and 140*d* that bridge between side parts which are spaced apart facing each other in a pair of side wall parts 134 and 135. These side plate parts 140*c* and 140*d* form container 110 together with bottom plate part 132 and a pair of side wall parts 134 and 135.

That is, in the four side wall parts surrounding container 110, a pair of side walls facing each other are formed only with outer plate frame 1422 and inner plate frame 1442 of shell part 140 formed with the metal plate, instead of using side wall parts of housing 130 made of a resin having a thickness. In other words, in connector 100, in the side wall parts surrounding container 110, the thickness of a pair of side wall parts facing each other (side plate parts 140*c* and 140*d*) is thinner than side wall parts including side wall parts 134 and 135 of housing 130, and the pair of side wall parts are formed by outer plate frame 1442 and inner plate frame 1422 formed by a stronger metal than resin side wall parts.

By this means, compared to conventional connectors that surround container 110 by surrounding walls, in connector 100 according to the present embodiment, the distance between the side wall parts is made shorter by the thickness of the length A of the side wall parts. Consequently, it is possible to make a smaller space for mounting a connector on the substrate than with conventional connectors.

Therefore, even if various electronic parts are mounted on a substrate following improvement in functions of communication mobile terminals such as mobile telephones with camera modules in recent years, it is possible to make a smaller space for mounting a connector on a substrate, which differs from a conventional connector that requires resin side wall parts of a housing for surrounding side wall parts that define the container.

Further, side plate parts 140*c* and 140*d* of shell part 140 formed with outer plate frames 1422 and inner plate frames 1442 have lock check window parts 146 that penetrate thorough the front and back faces of parts corresponding to the positions where the camera module inserted in container 110 engages with retaining members 150. These lock check window parts 146 enable operators to check the connector from outside by seeing the engaging state of retaining members 150 with respect to the camera module accommodated in container 110.

Further, side plate parts 140*c* and 140*d* of shell part 140 formed with outer plate frames 1422 and inner plate frames 1442 have contact check window parts 147 that penetrate the front and back faces of parts corresponding to the height of the point of contact where contacts of the camera module inserted in container 110 touch contact pins 120. These contact check window parts 147 enable operators to check the connector from outside by seeing the contact state of contact pins 120 of connector 100 with contacts of the camera module accommodated in the container.

Further, although, with connector 100 of the present embodiment, contact pins 120 provided in housing 130 are positioned such that contact parts 122 extend upward from the bottom face of container 110, the present invention is not limited to this, and a configuration may be possible where, in housing 130, pin arm parts 128 project toward container 110 from the inner peripheral faces of side wall parts 134 and 135 of housing 130 and touch contacts of the camera module in the side of the camera module accommodated in container 110.

Further, although notch parts 137 formed in housing 130 are formed on both sides of upper side parts 134*a* and 135*a* in a pair of side wall parts 134 and 135, the present invention is not limited to this, and any number of notch parts may be formed in any positions of parts of surrounding walls surrounding container 110.

Further, as long as the configuration prevents the camera module accommodated in container 110 from falling, any shape and any number of retaining members 150 arranged inside these notch parts 137 may be possible.

Further, in connector 100, the side wall parts surrounding container 110 have pressing plates 148 and retaining members 150 projecting from the inner peripheral faces toward container 110.

Here, from a plane view as shown in FIG. 6, pressing plates 148 and retaining members 150 are provided such that container 110 is surrounded as the center and press against camera module 200 (see FIG. 8) accommodated in container 110, toward the camera module.

By this means, retaining members 150 and pressing plates 148 are able to place camera module 200 in the center in container 110 and suitably insert camera module 200 in container 110.

Further, retaining member 150 is formed by carrying out the bending process on the long, flat flexible member forming shell part 140. Retaining member 150 is formed by carrying out the bending process on the long, flat metal plate that is elastically deformable at separate predetermined positions in the longitudinal direction.

Here, retaining member 150 is formed by bending part of the thin, flat metal plate forming shell part 140, that is, by bending a part of the metal plate continuing to lower frame 1421. That is, retaining member 150 is formed integrally with shell part 140 which is rectangular-shaped, so that it is possible to reduce labor upon assembling compared to the connector which is configured apart from shell part 140.

Further, as shown in FIG. 3, in connector 100, side plate part 140*d* of side plate parts 140*c* and 140*d* have keyway 140*e* opening upward. A convex part matching with this keyway 140*e* is provided with camera module 200 (see FIG. 8). When this camera module 200 is inserted in container 110, by inserting the camera module in container 110 positioning the convex part of the camera module above keyway 140*e*, it is possible to position the camera module smoothly inside container 110 while fitting the convex part into keyway 140*e* and guiding the convex part in the direction of insertion and specify the front, back, left and right directions of the camera module in the insertion.

Further, in connector 100, shell part 140 is box shaped and the metal plate is processed such that shell part 140 is formed integrally with retaining members 150. For this reason, when the connector with housing 130 and shell part 140 is assembled, it is possible to reduce labor upon assembling compared to cases where retaining members 150 are separate bodies.

Further, although, with the connector of the present embodiment, eight retaining members 150 prevent camera module 200 from falling, the present invention is not limited to this, and the number of retaining members 150 may be one, two, three, four or more. Further, the above present invention can be variously modified without departing from the spirit of the present invention, and it naturally follows that the present invention includes such modifications.

The connector according to the present invention is useful when modules such as camera modules are mounted detachably in electronic devices such as mobile phones.

What is claimed is:

1. A camera module connector comprising:

a connector body with a container in which a module is inserted and which opens upward;

a connecting part that is provided inside the container and that electrically connects with the module accommodated in the container; and a flexible retaining member that is provided in a side of the container in the connector body, and that comprises a body part which, when the module is inserted, deforms elastically such that a tip part of an arm part projecting into the container moves to the side of the container and which, when the module is accommodated in the container, restores to an original state to allow the tip part to engage with a front face of the module, wherein:

the body part comprises:

a first body part that is provided in the side of the container to bend from an outer side face of the connector body toward the container; and a second body part that extends from the first body part and is bent back from a tip of the first body part projecting toward the container to extend diagonally at an upward angle toward the side of the connector body; and the arm part is provided in an upper end part of the second body part such that the tip of the arm part inclines at a downward angle toward the container.

2. The camera module connector according to claim 1, wherein the connector body comprises a limiting wall part that is positioned on a side of an outer side face of the second body part to form the outer side face of the connector body and that limits movement of the second body part in the direction going away from the container.

3. The camera module connector according to claim 2, wherein the limiting wall part comprises an upper part that covers from above an outer face of the upper end part of the second body part.

* * * * *